US006125849A

United States Patent [19]

Williams et al.

[11] Patent Number: 6,125,849

[45] Date of Patent: Oct. 3, 2000

[54] RESPIRATORY MASKS HAVING VALVES AND OTHER COMPONENTS ATTACHED TO THE MASK BY A PRINTED PATCH OF ADHESIVE

[75] Inventors: Elfed I. Williams, Swansea; Desmond T. Curran, Durham, both of United Kingdom

[73] Assignee: 3M Innovative Properties Company, St. Paul, Minn.

[21] Appl. No.: 09/189,673

[22] Filed: Nov. 11, 1998

[30] Foreign Application Priority Data

Nov. 11, 1997 [GB] United Kingdom ..... 9723740

[51] Int. Cl.[7] ..... A62B 7/10

[52] U.S. Cl. ..... 128/206.12; 128/206.28

[58] Field of Search ..... 128/206.12, 206.13, 128/206.16, 206.19, 206.25, 206, 28, 206.21, 207.11; 156/313, 277, 291

[56] References Cited

U.S. PATENT DOCUMENTS

| | | | |
|---|---|---|---|
| 2,280,620 | 4/1942 | Binns et al. . | |
| 3,521,630 | 7/1970 | Westberg et al. . | |
| 4,183,978 | 1/1980 | Hefele | 427/202 |
| 4,215,682 | 8/1980 | Kubik et al. . | |
| 4,419,993 | 12/1983 | Petersen . | |
| 4,536,440 | 8/1985 | Berg . | |
| 4,592,815 | 6/1986 | Nakao . | |
| 4,600,002 | 7/1986 | Maryyanek et al. . | |
| 4,627,345 | 12/1986 | Watts . | |
| 4,807,619 | 2/1989 | Dyrud et al. . | |
| 4,827,924 | 5/1989 | Japuntich . | |
| 4,850,347 | 7/1989 | Skov . | |
| 4,874,399 | 10/1989 | Reed et al. . | |
| 4,920,960 | 5/1990 | Hubbard et al. . | |
| 5,020,533 | 6/1991 | Hubbard et al. . | |
| 5,025,052 | 6/1991 | Crater et al. . | |
| 5,080,094 | 1/1992 | Tayebi . | |
| 5,099,026 | 3/1992 | Crater et al. . | |
| 5,307,796 | 5/1994 | Kronzer et al. . | |
| 5,322,061 | 6/1994 | Brunson . | |
| 5,325,892 | 7/1994 | Japuntich . | |
| 5,374,458 | 12/1994 | Burgio . | |
| 5,406,943 | 4/1995 | Hubbard et al. | 128/206.12 |
| 5,411,576 | 5/1995 | Jones et al. . | |
| 5,453,143 | 9/1995 | Menard | 156/204 |
| 5,472,481 | 12/1995 | Jones et al. . | |
| 5,496,507 | 3/1996 | Angadjivand et al. . | |
| 5,593,759 | 1/1997 | Vargas et al. | 428/200 |
| 5,617,849 | 4/1997 | Springett et al. | 128/206.24 |
| 5,620,785 | 4/1997 | Watt et al. | 428/219 |
| 5,682,879 | 11/1997 | Bowers | 128/206.19 |
| 5,706,803 | 1/1998 | Bayer | 128/205.27 |
| 5,706,804 | 1/1998 | Baumann et al. . | |
| 5,709,915 | 1/1998 | Tomic et al. | 428/35.2 |
| 5,724,677 | 3/1998 | Bryant et al. . | |
| 5,792,299 | 8/1998 | Mosher, Jr. | 156/230 |
| 5,834,386 | 11/1998 | Cohen | 442/382 |
| 5,883,026 | 3/1999 | Reader et al. | 442/382 |

FOREIGN PATENT DOCUMENTS

| | | |
|---|---|---|
| 0 281 275 | 9/1988 | European Pat. Off. . |
| 0 469 498 A2 | 2/1992 | European Pat. Off. . |
| 1569812 | 6/1980 | United Kingdom . |
| WO 96/11594 | 4/1996 | WIPO . |
| WO 96/28217 | 9/1996 | WIPO . |
| WO 97/32493 | 9/1997 | WIPO . |
| WO 97/32494 | 9/1997 | WIPO . |

*Primary Examiner*—Aaron J. Lewis
*Assistant Examiner*—Teena Mitchell
*Attorney, Agent, or Firm*—Cecilia A. Hill; Karl G. Hanson

[57] ABSTRACT

A respiratory mask comprises a body portion that is formed from an air-permeable material and that has at least one component, for example an exhalation valve, secured to the body portion by a printed patch of adhesive. In one embodiment, the mask is a fold-flat mask (1) comprising panels (3, 5, 7) each of which is formed from superposed layers of air-permeable material. An exhalation valve (13) is secured to the center panel (3) by a patch of adhesive that is printed on the outer layer of the panel. Use of a printed patch of adhesive enables components to be accurately secured to the mask body at high speeds.

20 Claims, 7 Drawing Sheets

RESPIRATORY MASKS HAVING VALVES AND OTHER COMPONENTS ATTACHED TO THE MASK BY A PRINTED PATCH OF ADHESIVE

This application claims priority under 35 U.S.C. § 119 to United Kingdom Patent Application No. 9723740.8 filed Nov. 11, 1997.

The present invention pertains to respiratory masks that are formed from one or more layers of air-permeable material and that incorporate attached components such as valves, headbands and the like.

BACKGROUND

Respiratory masks are used in a wide variety of applications to protect a human's respiratory system from particles suspended in the air or from unpleasant or noxious gases. They are also frequently worn by, for example, medical care providers to prevent the spread of harmful micro-organisms either to or from the user.

Some respiratory masks are formed predominantly from one or more layers of air-permeable material. Such masks generally have a limited useful life, following which they are intended to be discarded, and generally fall into two categories—moulded cup-shaped masks and fold-flat masks. Moulded cup-shaped masks offer the advantage of having a firmly constructed mask body that is spaced from the wearer's face. Moulded cup-shaped masks that are formed from one or more layers of air-permeable material are described in, for example, GB-A-1 569 812 and 2 280 620, and in U.S. Pat. Nos. 4,536,440; 4,807,619; 4,850,347; 5,307,796; and 5,374,458. Fold-flat masks offer the advantage that, if desired, they can be constructed to fold flat for storage, allowing them to be carried in a wearer's pocket until needed and re-folded so that they can be kept clean between uses. A mask of that type, which opens out to provide a cup-shaped air chamber over the mouth and nose of the wearer during use, is described in WO 96/28217 and U.S. patent application Ser. No. 08/612,527. Other fold-flat masks formed from layers of air-permeable material are described in, for example, U.S. Pat. Nos. 5,322,061; 5,020,533; 4,920,960; and 4,600,002.

A respiratory mask that is formed from one or more layers of air-permeable material generally incorporates at least one attached component, most typically a headband or ties by which the mask can be secured to the user's head. The mask may, however, incorporate other attached components including valves, nose clips and face shields all of which are well known. A method that is frequently employed for attaching such components is ultrasonic welding (as mentioned in U.S. Pat. No. 5,325,892), although, for some components, adhesive bonding and mechanical clamping are also known (as mentioned in U.S. Pat. Nos. 5,374,458 and 5,080,094, and in WO 96/11594 and 96/28217).

SUMMARY OF THE INVENTION

The present invention is concerned with providing an alternative method of attaching components, such as valves, to respiratory masks that include from one or more layers of air-permeable material in the mask body.

In brief summary, the present invention provides a respiratory mask that comprises:

(a) a respirator body that is formed from at least one layer of air-permeable material and that is shaped to fit over at least the nose and mouth of a wearer; and (b) at least one component that is secured to the air-permeable material by a printed patch of adhesive. The adhesive patch may, for example, be a screen-printed patch.

The present invention further provides a method of manufacturing the body of a respiratory mask from an air-permeable material, which method comprises the steps of:

(a) printing at least one adhesive patch on the air-permeable material;

(b) positioning a component of the mask on the adhesive patch to secure the component to the material; and (c) forming the material into a mask body capable of fitting over at least the nose and mouth of a wearer. In a method in accordance with the invention, the steps do not necessarily have to be carried out in the order in which they have just been specified.

The term "printed patch of adhesive" means a patch of adhesive left on either the air-permeable material or the component by temporary contact between a printing surface, in which the shape of the patch of adhesive is predefined, and either the air-permeable material or the component as the case may be. The term includes the case in which the printing surface is a screen or a plate with raised or depressed areas, but excludes the case in which the printing surface is a surface of the component. The term "printing" means a process by which a printed patch of adhesive is formed.

The use of a printing process to form patches of adhesive for securing components during the manufacture of respiratory masks enables the masks to be manufactured at high speeds. The adhesive patches also can be positioned very accurately on the air permeable material or on the component. The invention has been found to be suitable for making respirators at speeds faster than obtained using known techniques such as ultrasonic welding. Also the invention can more accurately and easily attach the components over known techniques such as gluing or stapling. The amount of adhesive used can be accurately controlled to supply an adhesive mask of predetermined size and arrangement. The invention thus is advantageous in that it enables rapid securement of components to respirator mask bodies at high accuracies.

BRIEF DESCRIPTION OF THE DRAWINGS

By way of example only, embodiments of the invention will be described with reference to the accompanying drawings, in which.

DETAILED DESCRIPTION OF PREFERRED EMBODIMENTS

Figure 1:
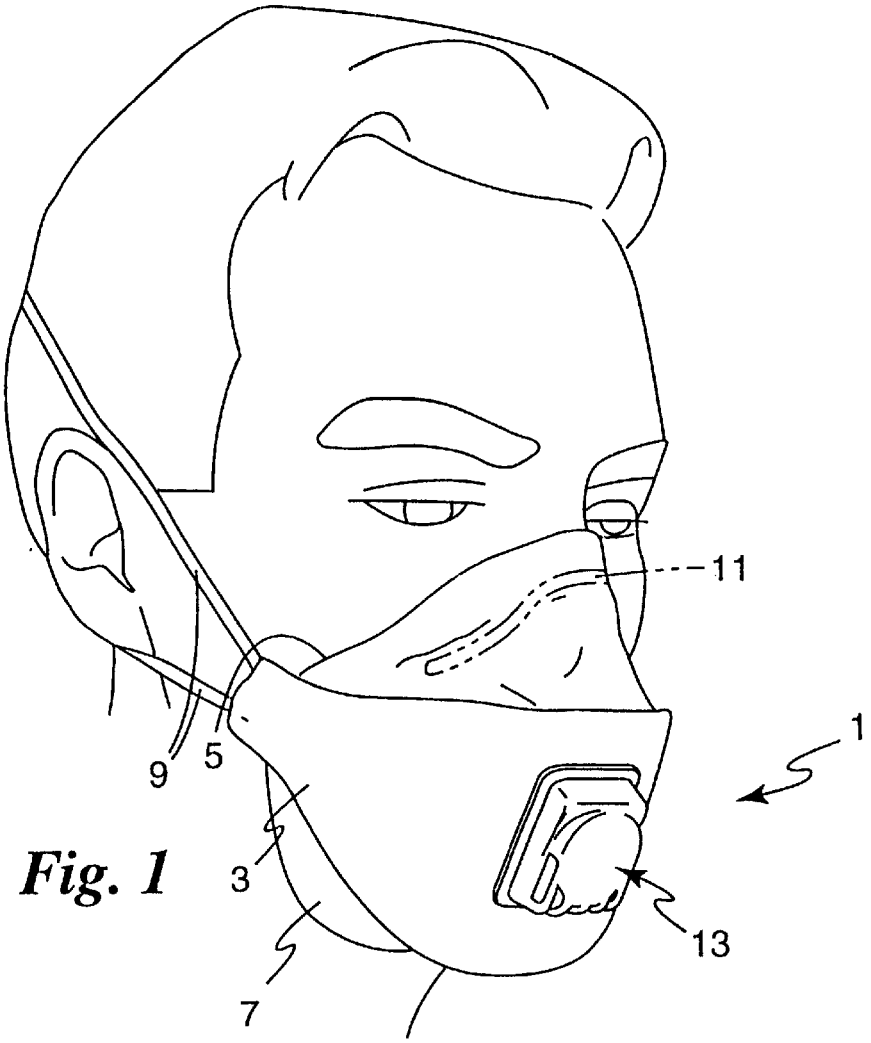
FIG. 1 shows a fold-flat respiratory mask in an open condition and on the face of a wearer.

FIG. 1 shows a fold-flat respiratory mask 1 in an opened condition and in use on the face of a wearer. The inside of the mask can be seen in FIG. 2. The mask body (which provides a generally cup-shaped chamber over the nose and mouth of the wearer) comprises a generally elliptical centre panel 3 and upper and lower panels 5, 7 each formed from at least one fabric web. A headband 9 (in this case, a two-part headband) secures the mask to the head of the wearer and a malleable nose clip 11 is provided inside the upper panel 5 to enable the mask to be fitted closely to wearer's face over the nose and cheeks. An exhalation valve 13, described in greater detail below, is located on the outside of the centre panel 3 to facilitate the passage of exhaled air from the mask interior to the ambient air.

Figure 2:
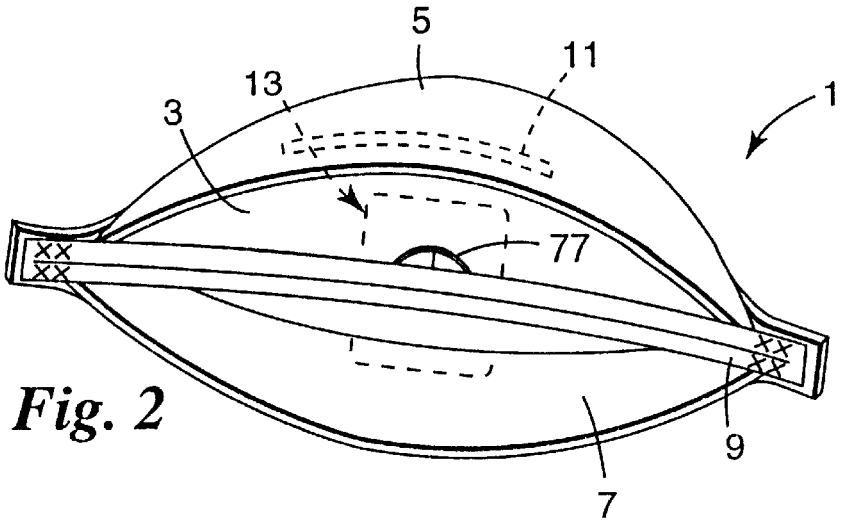
FIG. 2 is a rear view of the mask in the open condition of FIG. 1.
Figure 3:
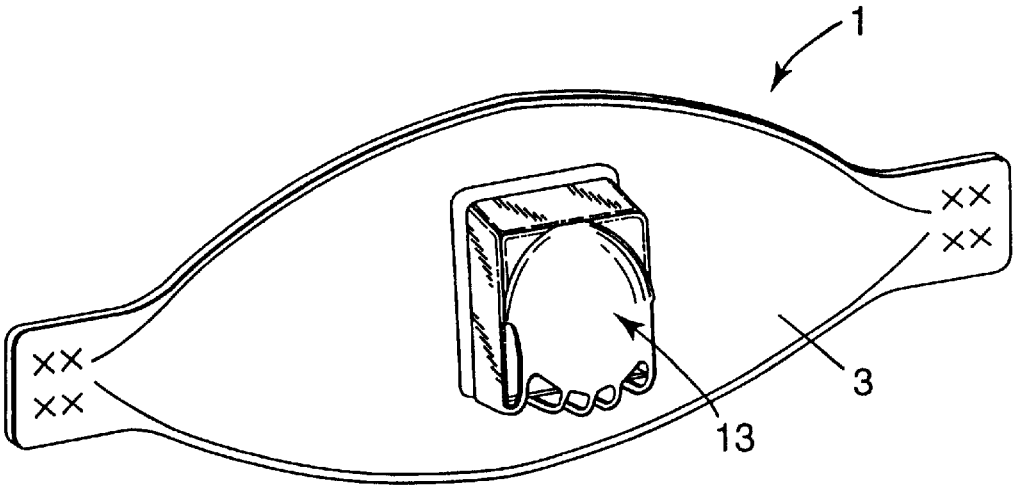
FIG. 3 is a front view of the mask in a flat-folded condition.
Figure 4:
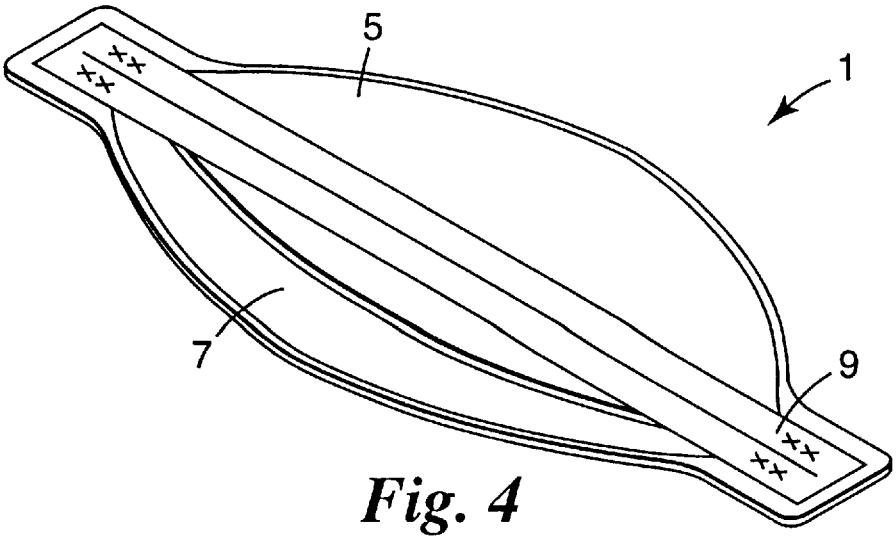
FIG. 4 is a rear view of the mask in the folded condition of FIG. 3.

The mask of FIGS. 1 and 2 can be folded flat for storage by turning the upper and lower panels 5, 7 down behind the centre panel 3, as illustrated by FIGS. 3 and 4.

Each of the panels 3, 5, 7 of the mask typically comprises at least one layer of filter material located between inner and outer cover webs. The centre panel 3 may also include a layer of reinforcing material, and the upper panel 5 may also include a strip of foam material.

Respiratory masks similar to that illustrated in FIGS. 1 to 4 are shown and described in U.S. patent applications Ser. Nos. 08/612,527, 29/059,264, 29/059,265, and 29/062,787, 29/065,342, and in International Publications WO 96/28217 and WO 97/32494.

Figure 5:
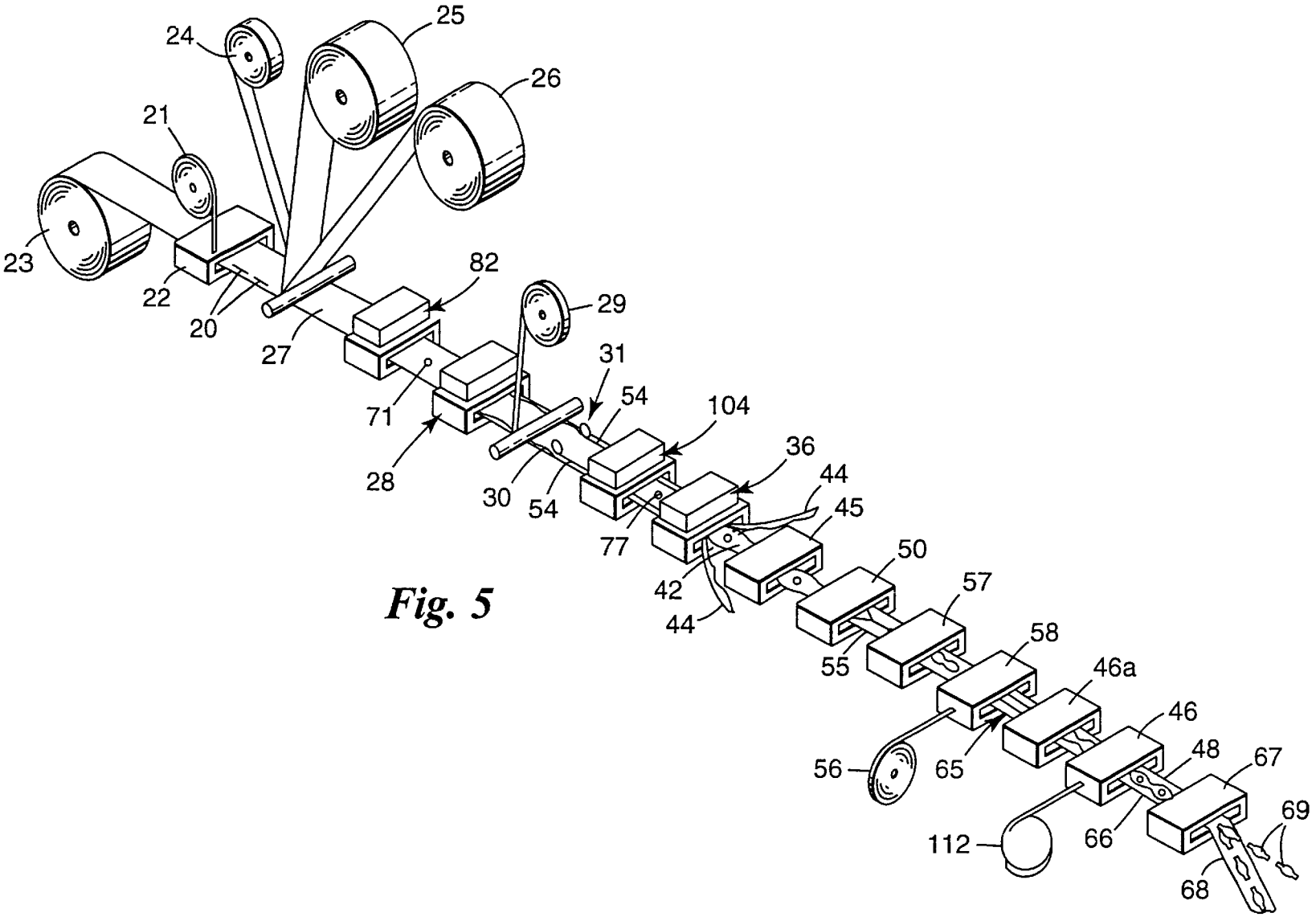
FIG. 5 is a schematic illustration of a process for manufacturing the respirator of FIGS. 1 to 4.
Figure 6:
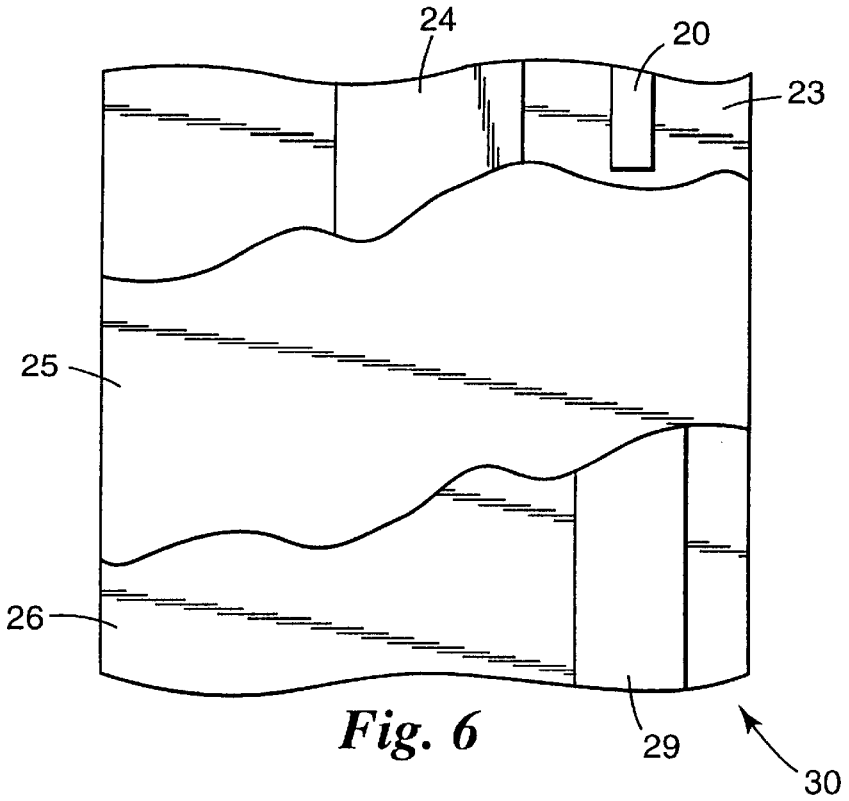
FIGS. 6 to 8 illustrate intermediate web configurations of the process of FIG. 5.

FIG. 5 is a schematic illustration of an exemplary process for the continuous manufacture of flat-folded respirators of the type shown in FIGS. 1 to 4. A succession of nose clips 20 is cut from a supply of nose clip material 21 at a nose clip application station 22 and positioned along one edge of an outer cover web 23. A reinforcing material 24 is positioned proximate centre on the cover web 23, and the nose clips and reinforcing material are covered by filter media 25 followed by an inner cover web 26. The web assembly 27 that is thus formed passes to a station 82 where series of circular seals 71, each extending through all the layers of the web assembly, are formed at a central location. The circular seals 71 define the locations of exhalation apertures to be formed subsequently during the passage of the web assembly 27 through the manufacturing line as described below. The seals 71 are formed by subjecting the web assembly 27 to heat and pressure between a patterned shaft and a backing shaft (not shown) but they could, alternatively, be formed by ultrasonic welding. The web assembly 27 then passes to a welding station 28 where it is welded along face-fitting edge lines 38, 40 (shown in FIG. 7 and referred to again later). A foam strip 29 is then positioned along one side of the inner cover web 26 above the nose clips 20, to form a web assembly 30 shown cut away in FIG. 6. The web assembly then passes underneath scoring wheels 31 which mark two parallel fold lines 54 in the web, for a purpose described below.

In alternative processes, the foam strip 29 and/or nose clips 20 may both be positioned on an outer surface of either the inner cover web 26 or outer cover web 23 or the foam strip 29 may be positioned within the layers of the web assembly. As yet another modification, two or more layers of filter media may be included in the web assembly rather than just the single layer 25 illustrated in FIG. 5.

Figure 7:
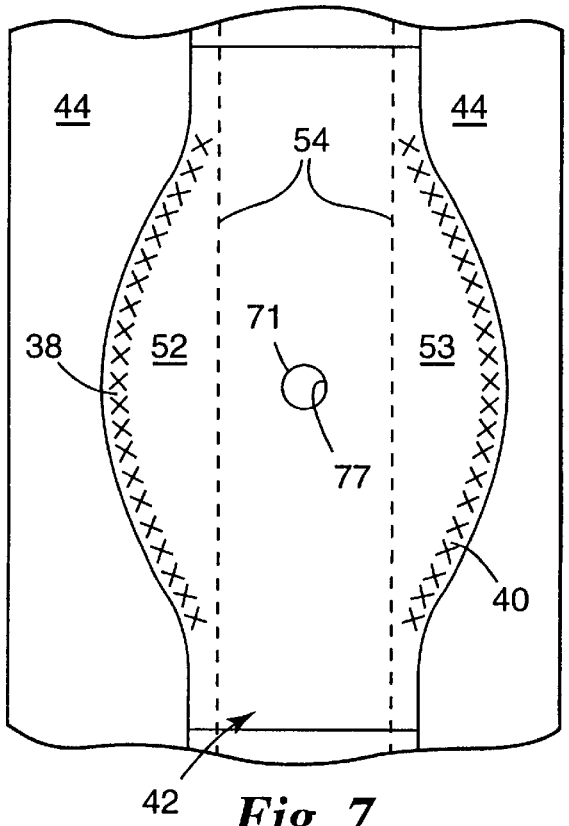

The web assembly 30 is now advanced to a cutting station 104 where the above mentioned exhalation apertures are die cut inside the circular seals 71. The exhalation apertures are indicated in FIG. 5 by the reference numeral 77. The web assembly 30 is then advanced to a cutting station 36, where it is trimmed along the face-fitting edge lines 38, 40 to form a trimmed web assembly 42 as illustrated in FIG. 7. The excess web material 44 on each side of the trimmed web assembly 42 is removed and the trimmed web assembly is advanced to a nose clip forming station 45 in which the nose clips 20 may be formed to a particular shape if required. The station 45 is, however, optional and can be omitted.

The web assembly 42 is then advanced to a folding station 50 where portions 52, 53 (FIG. 7) on the outer sides of the parallel fold lines 54 which were formed by the scoring wheels 31 are folded inward to form a continuous line 55 of folded face mask blanks.

Figure 8:
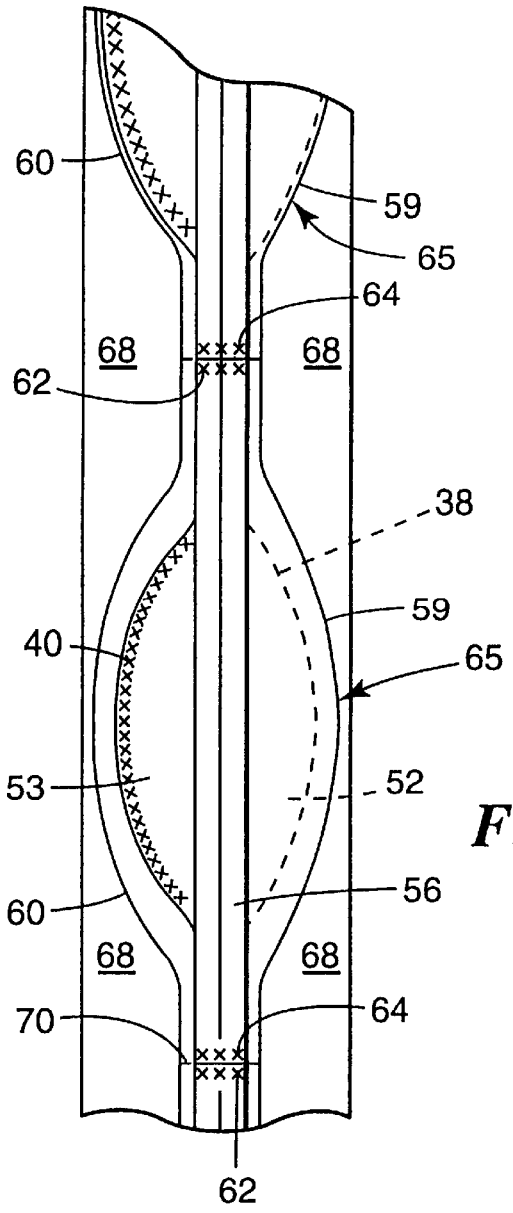

The folded face mask blanks are then advanced to welding and headband attaching stations 57, 58, at which the blanks are welded along lines 59, 60 (FIG. 8) adjacent, respectively, to the current locations of the face fit edge lines 38, 40. The headband material 56 is applied and attached at locations 62, 64 forming a web assembly 65 of welded mask blanks with excess material 68 as shown in FIG. 8. The face-fit edge line 40 is visible in FIG. 8 adjacent weld line 60 but the other face-fit edge line 38 is shown in dashed lines since it is beneath the folded-over web portion 53.

The assembly 65 is then advanced to a 180° flip-over station 46*a* to invert the web so that the folded portions 52, 53 are on the underside. The inverted assembly 65 then passes into a valving station 46 where (as will be described in greater detail below) exhalation valves 48 are attached to the outer cover web 23 on the uppermost side of the assembly 65, over the exhalation apertures 77. The valved web assembly 66 is then advanced to a cutting station 67 where the excess material 68 beyond the weld lines 59, 60 is removed, and transverse cuts are made along the lines 70 (FIG. 8) adjacent to the headband attachment locations 62, 64 to produce discrete face masks 69. The face masks 69 are then packaged.

Figure 9:
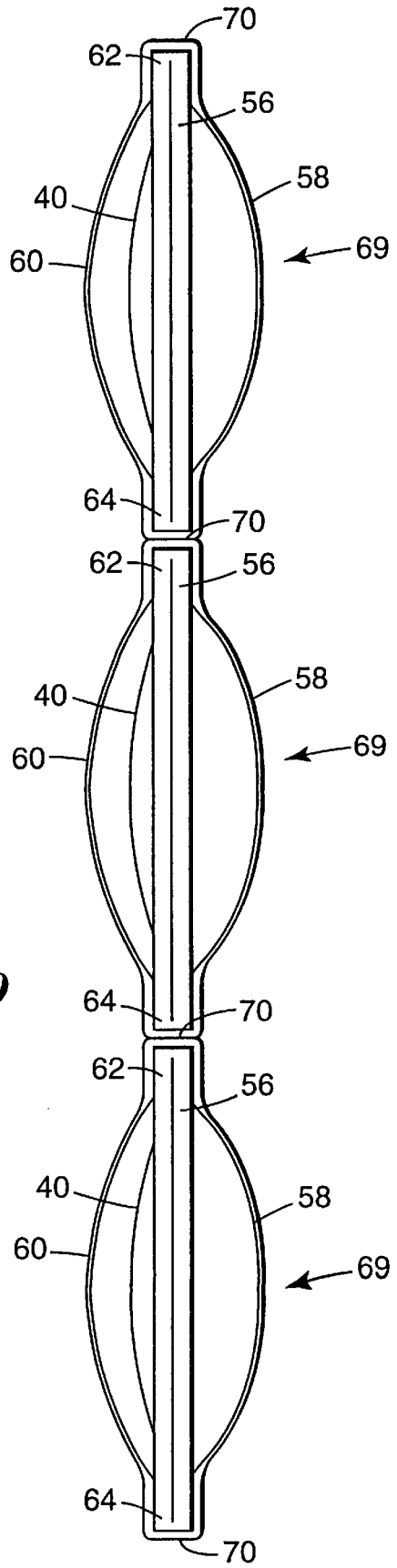
FIG. 9 shows a strip of respiratory masks produced by the process of FIG. 5.

The junction lines 70 between the masks 69 may alternatively be perforated to form a strip of face masks as shown in FIG. 9. In that case, the masks 69 can be packaged in a roll. A portion of the headband material 56 at the edges 70 may be removed by the perforation process, as illustrated in FIG. 9. Alternatively, the headband material may be left to terminate at the edges 70.

Regardless of whether the masks are separated completely from each other or not, the packaging into which the masks are put may take the form of a continuous wrapping which is perforated at locations corresponding to the regions between adjacent masks. In that way, the masks can be packaged in a roll even if they have already been separated from one another in the cutting station 67.

Various materials employed in the process illustrated in FIG. 5 (namely the filter media 25; the cover web materials 23, 26; the foam material 29; the stiffening material 24; the nose clip material 21; and the headband material 56) may be as described in U.S. patent application Ser. No. 08/881,348 and WO 96/28217. Alternatively, the headband material 56 may be as described in U.S. patent application Ser. No. 08/611,340 and International Publications WO 97/32493 or WO 97/32494. Many other forms of headband and headband attachments, however, are also contemplated including, for example, a headband that comprises two separate bands separately or individually joined to the mask.

Filter materials that are commonplace in respiratory masks like the mask 1 shown in FIGS. 1 to 4, often contain an entangled web of electrically charged melt-blown microfibers (BMF). BMF fibers typically have an average fiber diameter of about 10 micrometers ($\mu$m) or less. When randomly entangled in a web, they have sufficient integrity to be handled as a mat. Examples of fibrous materials that may be used as filters in a mask body are disclosed in U.S. Pat. Nos. 5,706,804; 5,472,481; 5,411,576 and 4,419,993. The fibrous materials may contain additives to enhance filtration performance, such as the additives described in U.S. Pat. Nos. 5,025,052 and 5,099,026 and may also have low levels of extractable hydrocarbons to improve performance. Fibrous webs also may be fabricated to have increased oily mist resistance as shown in U.S. Pat. No. 4,874,399. Electric charge can be imparted to non-woven BMF fibrous webs using techniques described in, for example, U.S. Pat. Nos. 5,496,507; 4,592,815; and 4,215,682. The outer and inner cover webs of the panels 3, 5 and 7 of the mask 1 protect the layer of filter material from abrasive forces and retain any fibers that may come loose from the filter material. The cover webs may also have filtering abilities, although typically not nearly as good as the layer of filter material. The cover webs may be made from non-woven fibrous materials containing polyolefins and polyesters (see, e.g. U.S. Pat. Nos. 4,807,619 and 4,536,440.

Figure 10:
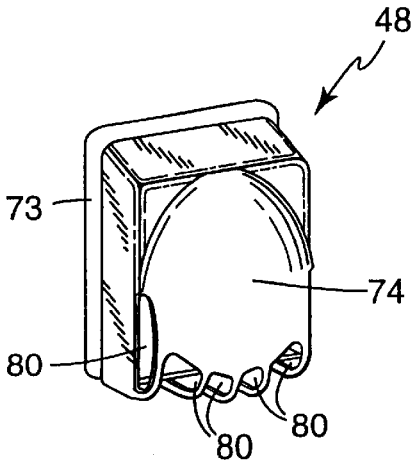
FIG. 10 is a perspective front view of the exhalation valve of the mask of FIGS. 1 to 4.
Figure 11:
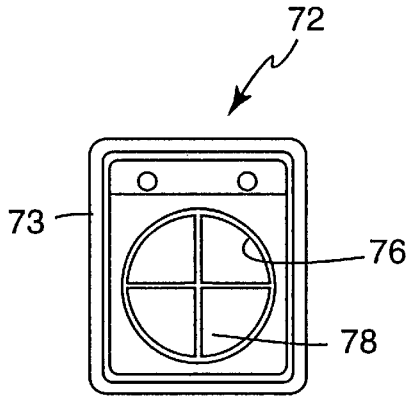
FIG. 11 is a rear view of the valve of FIG. 10.

The exhalation valves 48 employed in the process illustrated in FIG. 5 may be as shown in FIGS. 10 and 11. The valve shown in FIGS. 10 and 11 comprises a valve seat 72 over which is secured a raised valve cover 74. The valve seat 72 is provided with a flat rear surface, or flange, 73 by which the valve can be secured to the respiratory mask as will be described below. The valve seat contains a circular orifice 76 and, beneath the valve cover 74, carries a flexible valve flap 78 (partly visible in FIG. 11 through the orifice 76). When the valve is attached to a mask, the orifice 76 overlies an exhalation aperture 77 (FIG. 2) in the mask, as described below. The valve flap 78 is designed to seal against the valve seat 72 and close the orifice 76 when the wearer of the respiratory mask inhales, and to lift away from the valve seat and open the orifice when the wearer exhales. Inhaled air thus enters the mask through the filter media of the mask whereas exhaled air passes out through the exhalation aperture 77 in the mask, orifice 76 in the valve seat 72, and finally through openings 80 in the valve cover 74.

The valve shown in FIGS. 10 and 11 is of a type described in U.S. Pat. No. 5,325,892. The valve seat 72 and valve cover 74 are plastic moulded components, typically formed from a polypropylene material.

The manner in which the valves 48 are attached to the inverted web assembly 65 in the process of FIG. 5 will now be described. The valving station 46 of FIG. 5 comprises two process stations through which the inverted web assembly 65 passes as illustrated diagramatically in FIG. 12. The first of these process stations is an adhesive printing station 88 at which a patch of adhesive is printed on the outer cover web 23 (FIG. 5) on the topside of the web assembly 65, around each of the exhalation apertures 77 cut in station 104. One of the adhesive patches 90 is shown in FIG. 13, the patch being indicated in hatched lines. The outer shape of the patch 90 is generally rectangular and corresponds to the outer shape of the valve seat 72 of the exhalation valve (see FIG. 11). At the centre of the patch 90 is an adhesive-free circular region 92 concentric with the exhalation aperture 77 and the region defined by the circular seal 94 formed in the station 71 of FIG. 5. The dimensions of the adhesive patch 90 preferably are such that the adhesive-free centre region 92 is just slightly larger (typically by about 1 mm all around) than the exhalation aperture 77, and such that the outer edges of the patch lie just inside the outer edges of the flange 73 of the valve seat 72 (typically by about 1 mm). By forming the patch with those dimensions, it can be ensured that adhesive will not spread around the edges of the valves 45 when the latter are subsequently attached, or be deposited inside the exhalation apertures 77. FIG. 13 also shows that the exhalation aperture 77 is located inside the circular seal 94 and that the adhesive-free centre region 92 of the adhesive patch 90 terminates in the region of the web 23 between the valve aperture and the seal (so that the latter is covered by the adhesive patch).

The adhesive patches 90 are applied to the web assembly 65 by a rotary screen-printing process employing a cylindrical print screen 98 and a backup roll 100. The web assembly 65 passes between the print screen 98 and the back-up roll 100, with the print screen located on the topside of the web assembly. The print screen 98 is provided with the desired pattern of the adhesive patches 90, and a coating head 102 supplies a flowable hot melt adhesive to the interior of the screen from where it is pressed through the patterned screen by a doctor blade (not shown) and deposited on the web assembly 65. The coating head 102 is a precision slot die, enabling the amount of adhesive distributed on the screen 98 to be accurately controlled. The patterning of the printing screen 98 can, as is known, also be carried out extremely accurately using etching techniques thereby enabling the adhesive patches 90 to be printed on the web assembly with high precision. The surface speed of the backup roll 100 should be matched to the linear speed of the web assembly 65 through the process of FIG. 5, possibly with a small difference in speed built-in to smear-out the pattern of the screen from the printed patches. The printing screen 98 would typically carry several repeat patterns of the adhesive patch 90, spaced apart at a distance determined by the dimensions of the respiratory masks that are being produced.

After the adhesive printing station 88, the web assembly 65 advances to a valve attachment station 106 in which it passes under placement heads where the exhalation valves 48 (supplied to the placement heads by feeder 112 and an escapement mechanism 113) can be positioned in the correct orientation on the successive adhesive patches 90. The valved web assembly 66 then passes to the cutting station 67 of FIG. 5, already described above.

Following placement of the exhalation valves 48 on the web assembly 65, it may be necessary to hold the valves on the web (by means of supporting belts, for example) and/or to cool the valves (by means of cold air, for example) until an adequate degree of adhesion is achieved. Adhesion of the valves to the web is assisted by the use of an adhesive having a high degree of initial tack.

Figure 12:
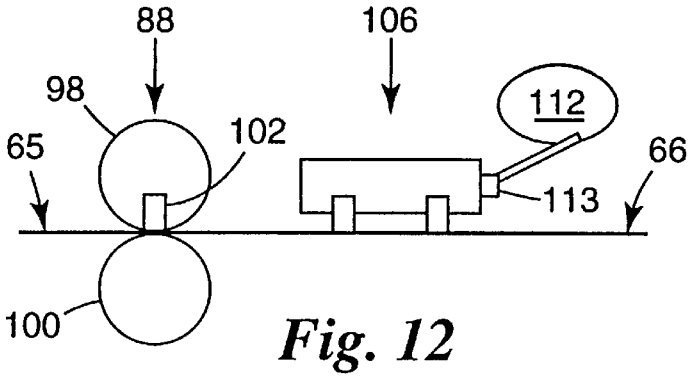
FIG. 12 is a diagrammatic illustration of a process for attaching the exhalation valve of FIGS. 10 and 11.
Figure 13:
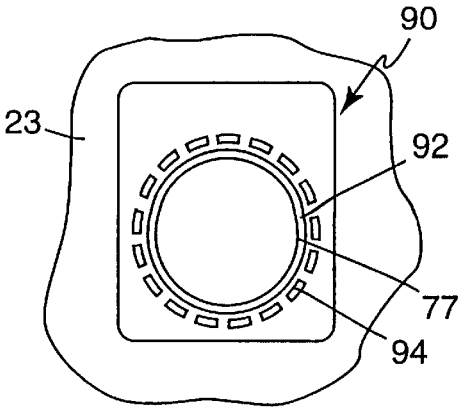
FIG. 13 shows the shape of a printed adhesive patch applied to a web during the process illustrated in FIG. 12.

Rotary screen printing apparatus suitable for use in the adhesive printing station 88 of FIG. 12 is available, under the trade description "Hot Melt Rotary Screen Coating System", from Nordson Corporation of Norcross, Ga., USA and, under the trade description "Rotary Screen Hot-Melt Pattern Coater", from May Coating Technologies, Inc. of White Bear Lake, Minn., USA.

The hot melt adhesive used to form the patches 90 is selected having regard to the material of the outer cover web 23 of the web assembly 65 and the material from which the valve seat 72 of the exhalation valve 48 is formed. In the particular case in which the outer cover web 23 is a polypropylene spun-bond material and the valve seat 72 is also formed from polypropylene, an amorphous polyolefin-based hot melt adhesive or an EVA-based hot-melt adhesive may be employed. Suitable adhesives are available, under the trade designations "Jet Melt 3762 LM", Jet Melt 3792 LM", "Jet Melt 3748", and "Spray Bond 6111", from Minnesota Mining and Manufacturing Company of St. Paul, Minn., USA. To ensure that the adhesive is maintained at a sufficiently high temperature, the coating head 102 of the adhesive printing station 88 is heated. In addition, hot air may be supplied to the interior of the printing cylinder 98.

The coating weight of the adhesive for the patches 90 should be selected having regard to the exhalation valve 48 that is to be attached to the web assembly 65. Typically, the coating weight will be in the range of from 50 to 200 g/m$^2$.

Although FIG. 12 illustrates the application of valves to the topside of the web assembly 65, it would be possible to leave the web assembly unturned (i.e. eliminating the 180° turn prior to the valving station 46) so that the valves would be applied to the underside of the web. It is also possible to modify the process illustrated in FIG. 5 so that the steps of forming the circular seals 71 and the exhalation apertures 77 and attaching the valves 48 are carried out at different points in the process. For example, those steps could all be carried out at one location upstream of the folding station 50. As an alternative, referring to FIG. 5, the station 104 in which the exhalation apertures 77 are cut is moved to a location immediately after the station 82 in which the seals 71 are formed. It is also possible, as a further alternative, to cut the exhalation apertures 77 after the adhesive patches 90 have been applied rather than before.

As a further modification of the process illustrated in FIG. 5, the scoring wheels 31 are omitted, and the cutting station 36 is additionally provided with cutting wheels which, instead of marking fold lines, forms a series of spaced cuts in the web assembly to mark the locations at which the web will be folded at the station 50. The cuts may, for example, be about 2.5 cm. long and separated by a distance of about 1.5 mm.

The presence, in the mask 1 of FIGS. 1 to 4, of the circular seal 94 in combination with the adhesive layer provided by the patch 90 on the cover web 23 ensures that, when the mask is in use, there is no leakage path into the mask between the fabric layers of the panel 3. The sealing step could be omitted if the mask were formed from only one fabric layer. Although the circular seal 94 is shown in FIG. 13 as being formed by a broken seal line an effect that can be described as "stitching"), that is not essential. The seal line could, instead, be continuous and could define a straight-sided figure surrounding the exhalation aperture, rather than a circle. In addition, the exhalation aperture itself need not be circular but could have any other appropriate shape.

The use of the rotary screen-printing process to apply the adhesive patches 90 in the station 88 of FIG. 12 is particularly advantageous when the production process illustrated in FIG. 5 is carried out at high speed, since it allows the attachment of exhalation valves to the web assembly 65 at equally high speeds. The adhesive patches 90 can be accurately printed, with well-defined edges, and accurately positioned on the web assembly. By shaping the patch so that the area of adhesive applied to the web is just slightly smaller than the valve part that is to be attached to it, it can be ensured that no adhesive will spread around the edges of the valve. It can also be ensured that no adhesive will be deposited in the area of the pre-cut exhalation aperture 77 in the web assembly 65, to avoid adhesive depositing on the inner cover 26 of the upper and lower panels 5, 7 of the mask. The shape of the adhesive patch can, moreover, be varied since the screen printing apparatus 98, 102 is not restricted to the production of rectangular shapes.

As an alternative to the use of a screen printing process to apply the adhesive patches 90, an off-set gravure printing process could be used with comparable results.

As a further alternative to a printing process, depending on the shape of the adhesive patches, the adhesive could be slot die-coated onto the web assembly. Slot die-coating could, for example, be used to produce a rectangular adhesive patch including, through the use of a combination of slot dies, a rectangular patch with an adhesive-free region in the location of the exhalation aperture.

Although the attachment of exhalation valves has been described, a rotary screen-printing process as used in the station 88 of FIG. 12 (or an off-set gravure printing process) could be used to apply adhesive patches for the attachment of other components to a web assembly during the manufacture of respiratory masks including, for example, headbands and attachment items (such as buckles and snap fasteners) for headbands, nose clips, face seal gaskets, face shields, and neck bibs.

The valve attachment process described with reference to FIG. 12 is not restricted to respiratory masks of the type described with reference to FIGS. 1 to 4, or to use in the manufacturing process described with reference to FIG. 5. A similar valve attachment process could be used in the manufacture of other forms of respiratory masks from air permeable material.

As a further alternative, an attachment method similar to that described above may be used to attach items to a respiratory mask after the mask has been formed. In that case, the mask need not be a fold-flat mask but could, for example, be a cup-shaped mask as described in U.S. Pat. No. 5,307,796 or as described in U.S. Pat. No. 4,827,924.

Figure 14:
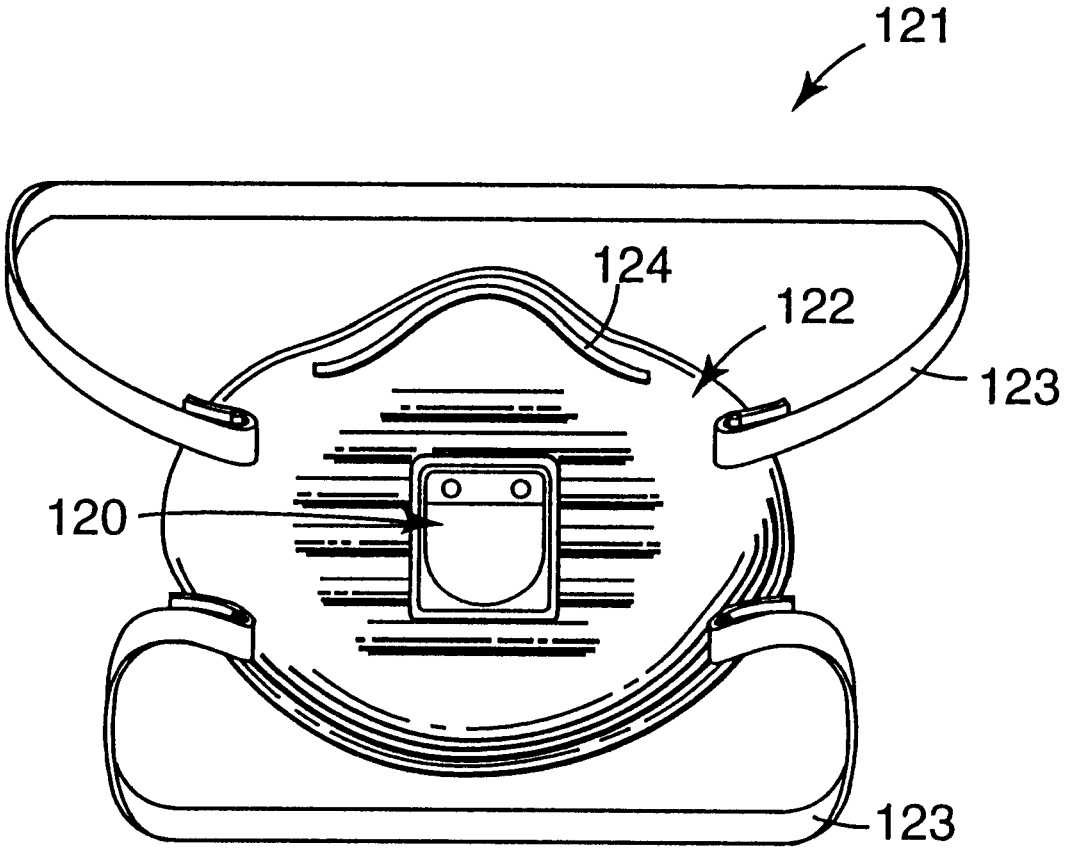
FIG. 14 is a front view of another mask incorporating an exhalation valve of the type shown in FIGS. 11 and 12.

FIG. 14, for example, shows an exhalation valve 120 (of a similar type to the valve 48 shown in FIGS. 10 and 11) attached to a disposable respiratory mask 121 of the type described in U.S. Pat. No. 5,307,796. The mask has a pre-formed cup-shaped mask body 122 intended, in use, to cover the mouth and nose of the wearer. The mask body 122 typically comprises at least a layer of filtration material, and a shaping layer which provides structure to the mask body and support for the filtration layer. The shaping layer can be made from a non-woven web of thermally-bondable fibres moulded, using known procedures, into a cup-shaped configuration. Following the formation of the cup-shaped mask body 122, an exhalation aperture (not visible) is formed in the mask body and the exhalation valve 120 is attached using a method similar to that illustrated in FIG. 12 and described above. More particularly, moulded mask bodies are fed at appropriate intervals and in a suitable orientation to a print screen roller (corresponding to the roller 98 of FIG. 12) which prints an adhesive patch on each mask body in registration with the exhalation aperture. The mask bodies then pass in succession to a valve attachment station where exhalation valves 120 are positioned in the correct orientation on the adhesive patches. Each mask body is then provided with straps 123 to hold it firmly to the wearer's face, and with a nose clip 124.

All of the patents and patent applications cited above are incorporated by reference into this patent application as if reproduced in total.

The present invention may be suitably practiced in the absence of any element not specifically described in this document.

What is claimed is:

1. A respiratory mask that comprises:

(a) a respirator body that is formed from at least one layer of air-permeable material and that is shaped to fit over at least the nose and mouth of a wearer; and (b) at least one component that is secured to the air-permeable material by a printed patch of adhesive.

2. The respiratory mask of claim 1, wherein the patch is a screen-printed patch that has been applied to the air-permeable material.

3. The respiratory mask of claim 1, wherein the outer shape of the adhesive patch corresponds to the outer shape of the part of the component that is secured to the material.

4. The respiratory mask of claim 1, wherein the adhesive is a hot melt adhesive.

5. The respiratory mask as claimed in claim 4, wherein the adhesive is an amorphous polyolefin-based adhesive or an EVA-based adhesive.

6. The respiratory mask of claim 5, wherein the coating weight of the adhesive is in the range of from 50 to 200 $g/m^2$.

7. The respiratory mask of claim 1, wherein the component is formed from a molded plastic material, and wherein the air-permeable material includes a spun-bond material.

8. A respiratory mask as claimed in claim 7, wherein the spun-bond material is a polypropylene spun bond material, and wherein the component is formed from a polypropylene material, at least in the region that is secured to the spun-bond material.

9. The respiratory mask of claim 1, wherein the respiratory body is formed from a plurality of superposed layers of air-permeable material, one at least of which comprises a filter material.

10. The respiratory mask of claim 9, wherein the component is an exhalation valve and wherein the adhesive patch surrounds an exhalation aperture in the respirator body.

11. A respiratory mask of claim 1, wherein the mask is capable of being folded flat for storage and, during use, being capable of forming a cup-shaped chamber over the mouth and nose of the wearer.

12. A method of manufacturing the body of a respiratory mask from an air-permeable material, the method comprising the steps of:

(a) printing at least one adhesive patch on the air-permeable material;

(b) positioning a component of the mask on the adhesive patch to secure the component to the material; and (c) forming the material into a mask body capable of fitting over at least the nose and mouth of a wearer.

13. The method of claim 12, wherein a plurality of adhesive patches are printed on the air-permeable material, and a respective mask component is positioned on each patch.

14. A method as claimed in claim 12, further comprising the steps of forming at least one respiratory mask blank from the air-permeable material and forming the blank into the mask body.

15. The method of claim 14, in which a succession of respiratory mask blanks is formed from the air-permeable material, and an adhesive patch is printed on each blank.

16. The method of claim 12, wherein the/each adhesive patch is screen-printed on the material.

17. The method of claim 12, wherein the outer shape of the/each adhesive patch corresponds to the outer shape of that part of the component that is to be secured to the material.

18. The method of claim 12, the adhesive is a hot melt adhesive.

19. The method of claim 12, wherein the air-permeable material comprises a plurality of superposed layers of material, one at least of which comprises a filter material, and wherein the component is an exhalation valve.

20. The method of claim 19, wherein the adhesive patch contains an adhesive-free region over the exhalation aperture.

* * * * *